US005080561A

United States Patent [19]

Taguchi

[11] Patent Number: 5,080,561

[45] Date of Patent: Jan. 14, 1992

[54] SLANT PLATE TYPE COMPRESSOR WITH VARIABLE DISPLACEMENT MECHANISM

[75] Inventor: Yukihiko Taguchi, Gunma, Japan

[73] Assignee: Sanden Corporation, Japan

[21] Appl. No.: 549,130

[22] Filed: Jul. 6, 1990

[30] Foreign Application Priority Data

Jul. 6, 1989 [JP] Japan ..... 1-176023

[51] Int. Cl.[5] ..... F04B 1/26

[52] U.S. Cl. ..... 417/222 S; 417/270

[58] Field of Search ..... 417/222 S, 270

[56] References Cited

U.S. PATENT DOCUMENTS

| | | | |
|---|---|---|---|
| 4,174,191 | 11/1979 | Roberts . | |
| 4,428,718 | 1/1984 | Skinner . | |
| 4,702,677 | 10/1987 | Takenaka et al. . | |
| 4,723,891 | 2/1988 | Takenaka et al. . | |
| 4,732,544 | 3/1988 | Kurosawa | 417/222 S |
| 4,747,753 | 5/1988 | Taguchi . | |
| 4,780,059 | 10/1988 | Taguchi | 417/270 |
| 4,842,488 | 6/1989 | Terauchi | 417/222 S |
| 4,913,626 | 4/1990 | Terauchi | 417/222 S |
| 4,913,627 | 4/1990 | Terauchi . | |
| 4,940,393 | 7/1990 | Taguchi | 417/222 S |
| 4,960,367 | 10/1990 | Terauchi | 417/222 S |

FOREIGN PATENT DOCUMENTS

| | | |
|---|---|---|
| 300831 | 1/1989 | European Pat. Off. . |
| 318316 | 5/1989 | European Pat. Off. . |
| 61-55380 | 3/1986 | Japan . |
| 61-261681 | 11/1986 | Japan . |
| 2019043 | 4/1979 | United Kingdom . |

*Primary Examiner*—Richard A. Bertsch
*Assistant Examiner*—Peter Korytnyk
*Attorney, Agent, or Firm*—Banner, Birch, McKie & Beckett

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. The incline angle is controlled by the relative pressure between the crank and suction chambers. The relative pressure is controlled by a control mechanism which comprises a passageway communicating between the crank chamber and a suction chamber, a first valve device to control the closing and opening of the passageway and a second valve device to control the pressure in an actuating chamber. The first valve device includes a bellows and a valve shifting element coupled to the bellows. The valve shifting element includes a first surface which receives pressure in the actuating chamber and a second surface which receives discharge pressure in order to apply a force to the bellows at another and thereby shift the response pressure of the bellows in response to changes in the actuating chamber pressure and changes in the discharge pressure.

31 Claims, 6 Drawing Sheets

SLANT PLATE TYPE COMPRESSOR WITH VARIABLE DISPLACEMENT MECHANISM

BACKGROUND OF THE INVENTION

1. Technical Field

The present invention relates to a refrigerant compressor, and more particularly, to a slant plate type compressor, such as a wobble plate type compressor, with a variable displacement mechanism suitable for use in an automotive air conditioning system.

2. Description of the Prior Art

It has been recognized that it is desirable to provide a slant plate type piston compressor with a displacement or capacity adjusting mechanism to control the compression ratio in response to demand. As disclosed in U.S. Pat. No. 4,428,718, the compression ratio may be controlled by changing the slant angle of the sloping surface of a slant plate in response to the operation of a valve control mechanism. The slant angle of the slant plate is adjusted to maintain a constant suction pressure in response to a change in the heat load of the evaporator of an external circuit including the compressor or a change in rotation speed of the compressor.

In an air conditioning system, a pipe member connects the outlet of an evaporator to the suction chamber of the compressor. Accordingly, a pressure loss occurs between the suction chamber and the outlet of the evaporator which is directly proportional to the "suction flow rate" therebetween as shown in FIG. 8. As a result, when the capacity of the compressor is adjusted to maintain a constant suction chamber pressure in response to appropriate changes in the heat load of the evaporator or the rotation speed of the compressor, the pressure at the evaporator outlet increases. This increase in the evaporator outlet pressure results in an undesirable decrease in the heat exchanging ability of the evaporator.

The above mentioned U.S. Pat. No. 4,428,718 discloses a valve control mechanism, to eliminate this problem. The valve control mechanism, which is responsive to both suction and discharge pressures, provides controlled communication of both suction and discharge fluid with the compressor crank chamber and thereby controls compressor displacement. The compressor control point for displacement change is shifted to maintain a nearly constant pressure at the evaporator outlet portion by means of this compressor displacement control. The valve control mechanism makes use of the fact that the discharge pressure of the compressor is roughly directly proportional to the suction flow rate.

However, in the above-mentioned valve control mechanism, a single movable valve member, formed of a number of parts, is used to control the flow of fluid both between the discharge chamber and the crankcase chamber, and between the crankcase chamber and the suction chamber. Thus, extreme precision is required in the formation of each part and in the assembly of the large number of parts into the control mechanism in order to attempt to ensure that the valve control mechanism operates properly. Furthermore, when the heat load of the evaporator or the rotation speed of the compressor is changed quickly, the discharge chamber pressure increases and an excessive amount of discharge gas flows into the crank chamber from the discharge chamber through a communication passage of the valve control mechanism, due to a lag time to between the operation of the valve control mechanism in response to the external circuit including the compressor. As a result of the excessive amount of discharge gas flow, a decrease in compression efficiency of the compressor, and a decline of durability of the compressor internal parts occurs.

To overcome the above-mentioned disadvantage, Japanese Patent Application Publication No. 1-142276 proposes a slant plate type compressor with a variable displacement mechanism which is developed to take advantage of the relationship between discharge pressure and suction flow rate. That is, the valve control mechanism of this Japanese '276 publication is designed to have a simple physical structure and to operate in a direct manner on a valve controlling element in response to discharge pressure changes, thereby resolving the complexity, excessive discharge flow and slow response time problems of the prior art.

However, in both the U.S. '718 Patent and Japanese '276 publication, the valve control mechanism maintains pressure in the evaporator outlet at a predetermined desired value by means of compensating for the pressure loss occurring between the evaporator outlet and the compressor suction chamber, in direct response to the pressure in the compressor discharge chamber, as shown in FIG. 7. That is, the pressure at the evaporator outlet is maintained constant as the discharge pressure increases, and as a result, the pressure in the suction chamber is decreased in order to compensate for the pressure loss between the evaporator outlet and the suction chamber. Thus, the pressure of the evaporator is maintained constant in dependence only on the magnitude of the discharge pressure, and other factors such as the pressure in the suction chamber and the external operating conditions of the air conditioning circuit are not taken into account. Furthermore, when, the displacement of the compressor is controlled in response to characteristics of the automotive air conditioning system, such as, the temperature of passenger compartment air or the temperature of air leaving the evaporator in addition to the change in the heat load of the evaporator or the change in rotation speed of the compressor, which is desired in order to more effectively operate the automotive air conditioning system, the pressure loss in the suction chamber must be compensated for by some further mechanism in order to avoid a loss in efficiency. Therefore, the above-mentioned technique of the prior art, in which the pressure loss in the suction chamber is not compensated for is not suited to elaborate operation of the automotive air conditioning system.

SUMMARY OF THE INVENTION

Accordingly, it is an object of this invention to provide a slant plate type compressor having a capacity adjusting mechanism, which compensates for the pressure loss, for suitable use in an elaborately operated automotive air conditioning system.

A slant plate type compressor in accordance with the present invention preferably includes a compressor housing having a front end plate at one of its ends and a rear end plate at its other end. A crank chamber and a cylinder block are preferably located in the housing and a plurality of cylinders are formed in the cylinder block. A piston is slidably fit within each of the cylinders and is reciprocated by a driving mechanism. The driving mechanism preferably includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle to the drive shaft. The incline angle of the member is adjustable to vary the stroke length of the reciprocating pistons and, thus, vary the capacity or displacement of the compressor. A rear end plate preferably surrounds a suction chamber and a discharge chamber. A first passageway provides fluid communication between the crank chamber and the suction chamber. An incline angle control device is supported in the compressor and controls the incline angle of the coupling mechanism member in response to pressure conditions in the compressor.

The compressor includes a valve control device including a valve element responding to the crank chamber pressure to open and close the first passageway, and a shifting mechanism shifting the response pressure of the valve element in response to pressure changes in an actuating chamber and the discharge pressure by applying a force to the valve element.

In a further embodiment, the response pressure shifting mechanism can also include a second valve control device for varying the pressure in the actuating chamber between the discharge chamber pressure to an appropriate pressure.

Further objects, features and other aspects of the invention will be understood from the detailed description of the preferred embodiments of this invention with reference to the drawings.

DETAILED DESCRIPTION OF THE PREFERRED EMBODIMENTS

In FIGS. 1–4, for purposes of explanation only, the left side of the FIGURES will be referenced as the forward end or front of the compressor, and the right side of the FIGURES will be referenced as the rearward end or rear of the compressor.

Figure 1:
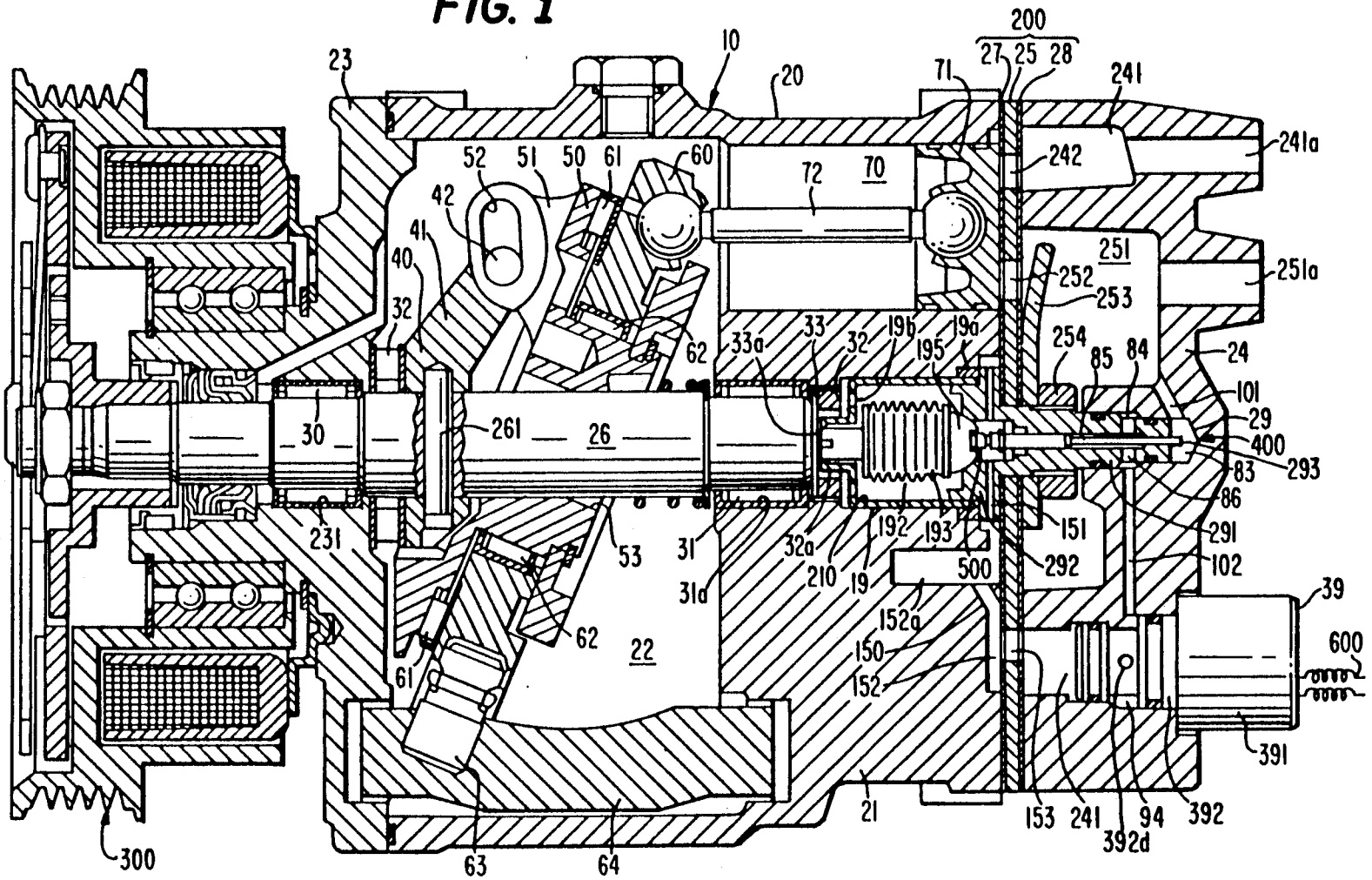
FIG. 1 is a vertical longitudinal sectional view of a wobble plate type refrigerant compressor including a valve control mechanism according to a first embodiment of this invention.

With reference to FIG. 1, the construction of a slant plate type compressor, specifically wobble plate type refrigerant compressor 10 including valve control mechanism 400 in accordance with a first embodiment of the present invention is shown. Compressor 10 includes cylindrical housing assembly 20 including cylinder block 21, front end plate 23 disposed at one end of cylinder block 21, crank chamber 22 enclosed within cylinder block 21 by front end plate 23, and rear end plate 24 attached to the other end of cylinder block 21. Front end plate 23 is mounted on cylinder block 21 forward of crank chamber 22 by a plurality of bolts (not shown). Rear end plate 24 is mounted on cylinder block 21 at the opposite end by a plurality of bolts (not shown). Valve plate 25 is located between rear end plate 24 and cylinder block 21. Opening 231 is centrally formed in front end plate 23 for supporting drive shaft 26 by bearing 30 disposed therein. The inner end portion of drive shaft 26 is rotatably supported by bearing 31 disposed within central bore 210 of cylinder block 21. Bore 210 extends to a rearward end surface of cylinder block 21, and first valve control mechanism 19 is disposed within bore 210. Disk-shaped adjusting screw member 32 having hole **32*a* centrally formed therein is disposed in a central region of bore 210 located between the inner end portion of drive shaft 26 and first valve control mechanism 19. Disk-shaped adjusting screw member 32 is screwed into bore 210 so as to be in contact with the inner end surface of drive shaft 26 through washer 33 having hole 33*a* centrally formed therein, and adjusts an axial position of drive shaft 26** by tightening and loosing thereof.

Cam rotor 40 is fixed on drive shaft 26 by pin member 261 and rotates with shaft 26. Thrust needle bearing 32 is disposed between the inner end surfaces of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 is disposed. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26.

Wobble plate 60 is nutatably mounted on slant plate 50 through bearings 61 and 62 which allow slant plate 50 to rotate with respect to wobble plate 60. Fork-shaped slider 63 is attached to the radially outer peripheral end of wobble plate 60 and is slidably mounted about sliding rail 64 disposed between front end plate 23 and cylinder block 21. Fork-shaped slider 63 prevents rotation of wobble plate 60, and wobble plate 60 nutates along rail 64 when cam rotor 40 and slant plate 50 rotate. Cylinder block 21 includes a plurality of peripherally located cylinder chambers 70 in which pistons 71 are disposed. Each piston 71 is connected to wobble plate 60 by a corresponding connecting rod 72. Nutation of wobble plate 60 causes pistons 71 to reciprocate in cylinder chambers 70.

Rear end plate 24 includes peripherally located annular suction chamber 241 and centrally located discharge chamber 251. Valve plate 25 includes a plurality of valved suction ports 242 linking suction chamber 241 with respective cylinder chambers 70. Valve plate 25 also includes a plurality of valved discharge ports 252 linking discharge chambers 251 with respective cylinder chambers 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator (not shown) of the external cooling circuit. Discharge chamber 251 is provided with outlet portion 251*a* connected to a condenser (not shown) of the cooling circuit. Gaskets 27 and 28 are located between cylinder block 21 and the inner surface of valve plate 25, and the outer surface of valve plate 25 and rear end plate 24, respectively, to seal the mating surfaces of cylinder block 21, valve plate 25 and rear end plate 24.

Figure 2:
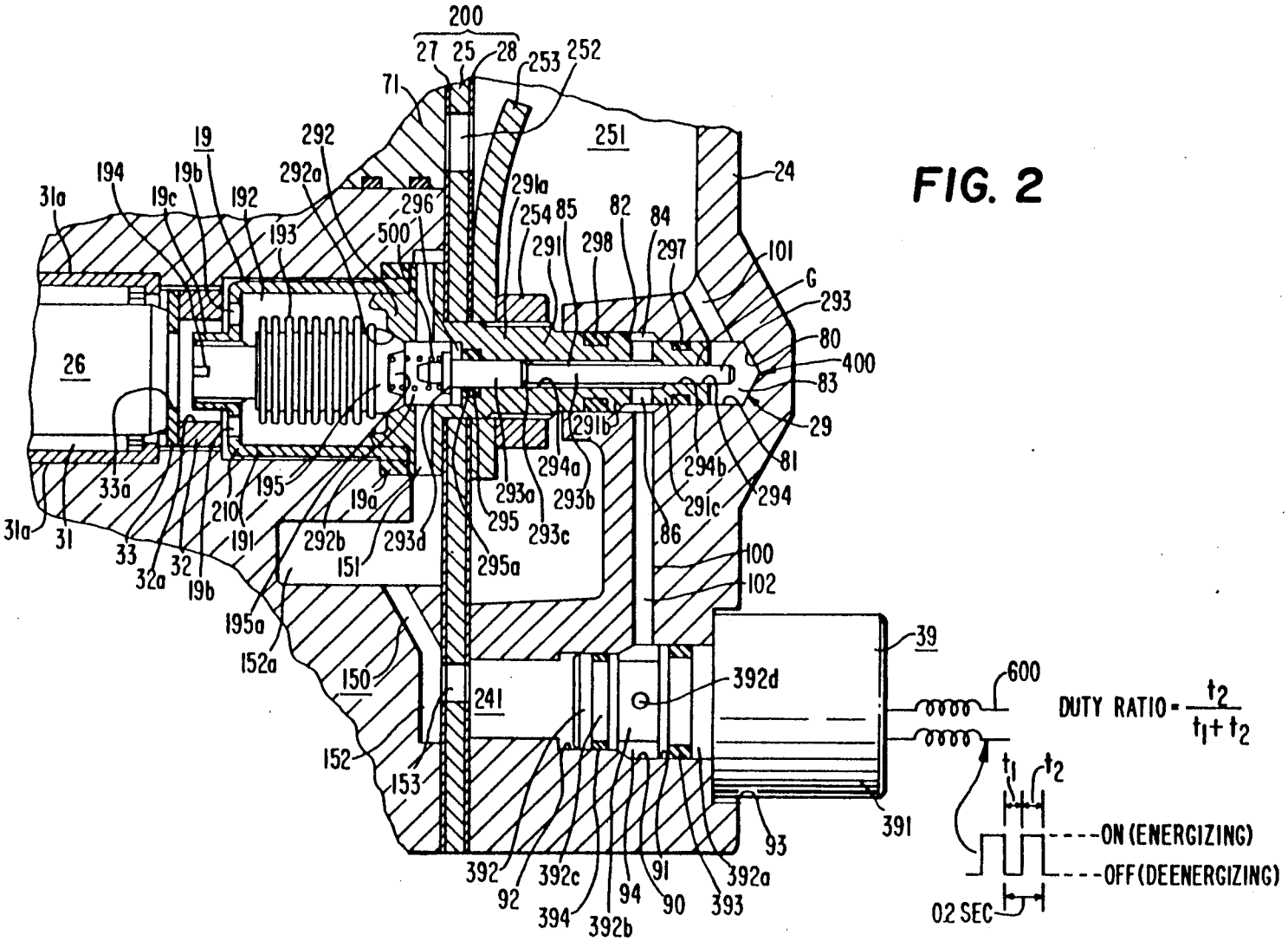
FIG. 2 is an enlarged partially sectional view of the valve control mechanism shown in FIG. 1.

With further reference to FIG. 1 and to FIG. 2, valve control mechanism 400 includes first valve control device 19 having cup-shaped casing member 191 disposed in central bore 210, and defining valve chamber 192 therein. O-ring 19*a* is disposed between an outer surface of casing member 191 and an inner surface of bore 210 to seal the mating surfaces of casing member 191 and cylinder block 21. A plurality of holes 19*b* are formed at a closed end of casing member 191, and crank chamber 22 is linked in fluid communication with valve chamber 192 through holes 19*b*, 32*a* and 33*a* and a gap 31*a* existing between bearing 31 and cylinder block 21. Thus, valve chamber 192 is maintained at the crank chamber pressure. Bellows 193 is fixedly disposed in valve chamber 192 and longitudinally contracts and expands in response to crank chamber pressure. Projection member 194 attached at the forward end of bellows 193 is secured to axial projection 19*c* formed at the center of the closed end of casing member 191. Hemispherical valve member 195 having circular depressed portion 195*a* at its rearward end is attached at the rearward end of bellows 193.

Cylinder member 291 includes integral valve seat 292, and penetrates through valve plate assembly 200 which includes valve plate 25, gaskets 27, 28, and suction and discharge reed valves (not shown). Valve seat 292 is formed at the forward end of cylinder member 291 and is secured to the open end of casing member 191. Nut 254 is screwed on cylinder member 291 from the rearward end of cylinder member 291 which extends beyond valve plate assembly 200 and into first cylindrical hollow portion 80 formed in rear end plate 24. Hollow portion 80 extends along the longitudinal axis of drive shaft 25 and is opened to discharge chamber 251 at one end. Nut 254 fixes cylinder member 291 to valve plate assembly 200, and valve retainer 253 is disposed between nut 254 and valve plate assembly 200. Spherical shaped opening 292*a* is formed at valve seat 292, and is linked to adjacent cylindrical cavity 292*b* formed at valve seat 292. Valve member 195 is disposed adjacent to valve seat 292. Actuating rod 293 is slidably disposed in cylindrical channel 294 axially formed through cylinder member 291 and is linked to valve member 195 through bias spring 500. Bore 295 is formed at the forward at the forward end of cylindrical channel 294, and is open to cylindrical cavity 292*b*. O-ring 295*a* is disposed in bore 295 to seal the mating surfaces of cylindrical channel 294 and actuating rod 293. Annular plate 296 is fixedly disposed at the rearward end of cylindrical cavity 292*b*, and covers bore 295 so as to prevent O-ring 295*a* from sliding out of bore 295.

First cylindrical hollow portion 80 includes small diameter hollow portion 81 and large diameter hollow portion 82 forwardly extending from the forward end of small diameter hollow portion 81. Cylinder member 291 includes large diameter region 291*a*, small diameter region 291*c* and medium diameter region 291*b* located between large and small diameter regions 291*a*, 291*c*. A male screw is formed at a part of an outer peripheral surface of large diameter region 291*a* of cylinder member 291 so as to receive nut 254 thereon. Small diameter region 291*c* has a diameter slightly smaller than the diameter of small diameter hollow portion 81. Small diameter region 291*c* is disposed in small diameter hollow portion 81, and only occupies about half of small diameter hollow portion 81 to define first chamber 83. Medium diameter region 291*b* has a diameter slightly smaller than a diameter of large diameter hollow portion 82, and is disposed in large diameter hollow portion 82. Medium diameter region 291*b* only occupies about half of large diameter hollow portion 82, and defines second chamber 84. O-ring 297 is disposed about an outer surface of small diameter region 291*c* of cylinder member 291 to seal the mating surface of small diameter hollow portion 81 and cylinder member 291. O-ring 298 is disposed about an outer surface of medium diameter region 291*b* of cylinder member 291 to seal the mating surfaces of large diameter hollow portion 82 and cylinder member 291. Thereby, second chamber 84 is hermetically isolated from both discharge chamber 251 and first chamber 83.

Cylindrical channel 294 includes large diameter portion 294*a* and small diameter portion 294*b* located at the rearward end of large diameter portion 294*a*. Large diameter portion 294*a* terminates about half way into small diameter region 291*c* of cylinder member 291. Small diameter portion 294*b* rearwardly extends from large diameter portion 294*a* and is open to first chamber 83.

Actuating rod 293 includes large diameter section 293*a*, small diameter section 293*b* located to the rear of large diameter section 293*a*, and truncated cone section 293*c* connecting large diameter section 293*a* to small diameter section 293*b*. Large diameter section 293*a* has a diameter slightly smaller than the diameter of large diameter portion 294*a* of cylindrical channel 294, and is slidably disposed in large diameter portion 294*a*. Large diameter section 293*a* terminates about one-third the way into large diameter portion 294*a*. Small diameter section 293*b* of actuating rod 293 extends beyond small diameter region 291*c* and has a diameter slightly smaller than a diameter of small diameter portion 294*b* of cylindrical channel 294. Small diameter section 293*b* is slidably disposed in small diameter portion 294*b* of cylindrical channel 294. Small diameter and truncated cone sections 293*b* and 293*c* of actuating rod 293 and an inner peripheral wall of large diameter portion 294*a* of cylindrical channel 294 cooperatively define third chamber 85. An effective area of truncated cone section 293*c* which receives the pressure in third chamber 85 is determined by the differential between the diameter of large diameter section 293*a* of actuating rod 293 with the diameter of small diameter section 293*b* of actuating rod 293. A plurality of radial holes 86 are formed in small diameter region 291*c* of cylinder member 291, and link second chamber 84 to third chamber 85.

Annular flange member 293*d* disposed forwardly of annular plate 296, is integrally formed on actuating rod 293, and prevents excessive rearward movement of actuating rod 293. In other words, the contact of flange member 293*d* with the forward end surface of annular plate 296 limits the rearward movement of rod 293. Bias spring 500 is in contact with the forward end surface of flange member 293*d* and the bottom surface of circular depressed portion 195*a* of valve member 195.

Radial hole 151 is formed at valve seat 292 to link cylindrical cavity 292b to one end opening of conduit 152 formed in cylinder block 21. Conduit 152 includes cavity 152a, and is linked to suction chamber 241 through hole 153 formed in valve plate assembly 200. Passageway 150 provides communication between crank chamber 22 and suction chamber 241 by uniting gap 31a, holes 33a and 32a, bore 210, holes 19b, valve chamber 192, spherical shaped opening 292a, cylindrical cavity 292b, radial hole 151, conduit 152 and hole 153.

As a result, the opening and closing of passageway 150 is controlled by the contracting and expanding of bellows 193 in response to crank chamber pressure.

Second cylindrical hollow portion 90, parallel to first cylindrical hollow portion 80, is formed in rear end plate 24. Second hollow portion 90 includes large diameter hollow portion 91 and small diameter hollow portion 92. Small diameter hollow portion 92 extends from the forward end of large diameter hollow portion 91 and is open to suction chamber 241. Bore 93 has a diameter larger than the diameter of large diameter hollow portion 91, and extends from the rearward end of large diameter hollow portion 91 and opens to the exterior of the compressor.

Solenoid valve mechanism 39, which is shown by a side elevational view in FIGS. 1 and 2. includes solenoid 391 and valve device 392 fixedly attached at the front end of solenoid 391. Valve device 392 is forcibly inserted into second hollow portion 90, and a front end surface of solenoid 391 is in contact with a bottom surface of bore 93. Valve device 392 includes large diameter section 392a extending from the forward end of solenoid 391, small diameter section 392b extending from the forward end of large diameter section 392a and medium diameter section 392c extending from the forward end of small diameter section 392b. Large diameter section 392a has a diameter slightly smaller than the diameter of large diameter hollow portion 91, and is disposed in large diameter hollow portion 91. Large diameter section 392a only occupies half of large diameter hollow portion 91. Small diameter section 392b is disposed in large diameter hollow portion 91, and terminates at the forward end of large diameter hollow portion 91. Medium diameter section 392c has a diameter slightly smaller than the diameter of small diameter hollow portion 92, and is disposed in small diameter hollow portion 92. Medium diameter section 392c terminates about two-thirds the way into small diameter hollow portion 92. Large, small and medium diameter sections 392a, 392b and 392c and an inner peripheral wall of large diameter hollow portion 91 cooperatively define annular cavity 94. O-ring 393 is disposed about an outer surface of large diameter section 392a of valve device 392 to seal the mating surfaces of large diameter hollow portion 91 and rear end plate 24. O-ring 394 is disposed about an outer surface of medium diameter section 392c of valve device 392 to seal the mating surfaces of small diameter hollow portion 92 and rear end plate 24.

First conduit 101 is formed in rear end plate 24 so as to link discharge chamber 251 to first chamber 83 of first hollow portion 80. Second conduit 102, perpendicular to first and second hollow portions 80 and 90, is also formed in rear end plate 24 so as to link second chamber 84 of first hollow portion 80 to annular cavity 94. Annular cavity 94 communicates with suction chamber 241 through radial throughbore 392d and a passageway (not shown) formed in valve device 392. Accordingly, communication path 100 linking third chamber 85 with suction chamber 241 includes radial holes 86, second chamber 84, second conduit 102, annular cavity 94, radial throughbore 392d and the unshown passageway. The passageway would be easily formed in valve device 392 by one skilled in the art so that the illustration thereof is omitted in FIGS. 1 and 2. For example, valve device 392 may be a solenoid valve. Solenoid valves are known in the art and operate to either allow or prevent fluid flow therethrough. Solenoid valve 392 may include a spool disposed therein. The spool would move in accordance with the energization of solenoid 391 to either permit or prevent fluid to flow through the unshown passageway.

The discharge gas conducted in first chamber 83 through conduit 101 is further conducted into third chamber 85 through small gap "G" formed between the inner peripheral surface of small diameter portion 294b of cylindrical channel 294 and the outer peripheral surface of small diameter section 293b of actuating rod 293. When discharge gas passes through gap "G", a pressure drop occurs because of the throttling effect of gap "G". Therefore, gap "G" functions as a throttling device, such as an orifice tube disposed in a communicating path which links discharge chamber 251 to third chamber 85.

In the above construction, when solenoid 391 receives the electricity from the exterior of the compressor through wires 600, valve device 392 acts to open the unshown passageway by the magnetic attraction force generated by solenoid 391. Thereby, the refrigerant gas in third chamber 85 flows into suction chamber 241 through communication path 100. On the other hand, when solenoid 391 does not receive the electricity, valve device 392 acts to close the passageway by virtue of the disappearance of magnetic attraction force. Thereby, the flow of refrigerant gas from third chamber 85 to suction chamber 241 is blocked.

As shown in FIG. 2, solenoid valve mechanism 39 receives a control signal, which controls the ratio of solenoid energizing time to solenoid deenergizing time, defined in a very short period of time, hereinafter calling the duty ratio control signal. The duty ratio control signal is defined by the following equation:

$$\text{duty ratio} = t_2/(t_1+t_2)\times 100\%,$$

wherein $t_2$ is the solenoid energization time and $t_1$ is the solenoid deenergization time. Preferably, the solenoid is constructed to have 0.2 second on/off frequency.

An opening area of the unshown passageway formed in valve device 392 for linking annular cavity 94 to suction chamber 241 is designed to be sized and shaped to have the volume of the refrigerant flowing into suction chamber 241 from third chamber 85 to be equal to or greater than the maximum volume of the refrigerant flowing into third chamber 85 from discharge chamber 251. Thereby, when solenoid valve mechanism 39 receives a duty ratio control signal of 100%, the refrigerant gas in third chamber 85 conducted from discharge chamber 251 freely flows into suction chamber 241 so that pressure in third chamber 85 decreases to the suction pressure. On the other hand, when solenoid valve mechanism 39 receives a duty ratio control signal of 0%, pressure in third chamber 85 approaches the discharge pressure because of the blockade of communication path 100. Furthermore, when solenoid valve mechanism 39 receives the duty ratio control signal between 100% and 0%, pressure in third chamber 85 becomes higher than the suction pressure and lower than the discharge pressure. Therefore, the duty ratio control signal applied to solenoid valve mechanism 39 enables solenoid valve mechanism 39 to effectively vary the pressure in third chamber 85 to any value between the discharge pressure and the suction pressure.

Since truncated cone section 293*c* of actuating rod 293 receives the pressure in third chamber 85 at its effective area, the force which tends to forwardly move actuating rod 293 is generated by 1) the pressure in third chamber 85 at the effective area of truncated cone section 293*c* of actuating the rod 293 and 2) the discharge pressure at the effective area of the rear end of small diameter section 293*b* of actuating rod 293. Furthermore, since the pressure in third chamber 85 varies in response to changes in the value of the duty ratio signal, the forward force generated by the pressure in third chamber 85 at the effective area of truncated cone section 293*c* varies in response to changes in the value of the duty ratio control signal.

A response pressure adjusting device is formed by the combination of several elements including actuating chamber 85 (also known as third chamber 85), first communicating path 101 (also known as first conduit 101), second communicating path 100, second valve control device 39, and actuating device 293 (also known as actuating rod 293). Actuating chamber 85 is linked to discharge chamber 251 through first communicating path 101, first chamber 83, and small gap G. Second communicating path 100 links actuating chamber 85 to suction chamber 241. Second communicating path 100 includes radial holes 86, second chamber 84, conduit 102, annular cavity 94, radial through bore 392*d*, and the unshown passageway within solenoid 391.

Solenoid 39 functions as a second valve control device to control the opening and closing of second communicating path 100 in order to vary the pressure in the actuating chamber 85 from the pressure in discharge chamber 251 to the pressure in suction chamber 241. Thus, actuating chamber 85 acts as a variable pressure chamber. Solenoid 391 opens second passageway 100 in response to an external signal delivered at a specified duty ratio.

Actuating device 293 has a first surface 293*c* which receives the pressure in actuating chamber 85, and a second surface on the end thereof which receives the pressure of discharge chamber 251. Actuating device 293 thereby applies a force to first valve control device 19 which controllably changes the predetermined response pressure at which first valve control device 19 responds. The force on actuating device 293 is based on the changes in pressure in actuating chamber 85 and changes in pressure in discharge chamber 251 as controlled by the energization state of solenoid 391.

Second valve control device 29 is jointly formed by solenoid valve mechanism 39, first and second conduits 101 and 102, first and second cylindrical hollow portions 80 and 90, cylinder member 291 and actuating rod 293. Valve control mechanism 400 includes first valve control device 19 which acts as a valve control responsive at a predetermined crank chamber pressure to control the opening and closing of passageway 150, and second valve control device 29 which acts to adjust the pressure at which first valve control device 19 responds.

During operation of compressor 10, drive shaft 26 is rotated by the engine of the vehicle through an electromagnetic clutch 300. Cam rotor 40 is rotated with drive shaft 26, rotating slant plate 50 as well, which causes wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion 241*a* flows into each cylinder 70 through suction ports 242 and is then compressed. The compressed refrigerant gas is discharged to discharge chamber 251 from each cylinder 70 through discharge ports 252, and therefrom into the cooling circuit through outlet portion 251*a*.

The capacity of compressor 10 is adjusted to maintain a constant pressure in suction chamber 241 in response to changes in the heat load of the evaporator or changes in the rotating speed of the compressor. The capacity of the compressor is adjusted by changing the angle of the slant plate, which is dependent upon the crank chamber pressure or more precisely, the difference between the crank chamber and suction chamber pressures. During operation of the compressor, the pressure in crank chamber 22 increases due to blow by gas flowing past pistons 71 as they are reciprocated in cylinders 70. As the crank chamber pressure increases relative to the suction pressure, the slant angle of the slant plate and thus of the wobble plate decreases, decreasing the capacity of the compressor. A decrease in the crank chamber pressure relative to the suction pressure causes an increase in the angle of the slant plate and the wobble plate, and thus an increase in the capacity of the compressor. The crank chamber pressure is decreased relative to the suction chamber pressure whenever it is linked to suction chamber 241 due to contraction of bellows 193 and the corresponding opening of passageway 150.

The operation of first and second valve control devices 19 and 29 of compressor 10 in accordance with the first embodiment of the present invention is carried out in the following manner. When the value of the duty ratio control signal is increased, the forward force generated at truncated cone section 293*c* of actuating rod 293 is decreased due to a decrease in pressure in third chamber 85 towards the suction pressure. On the other hand, when the value of the duty ratio signal is decreased, the forward force generated at truncated cone section 293*c* of actuating rod 293 is increased due to an increase of the pressure in third chamber 85 towards the discharge pressure.

In operation of the compressor, the link between the crank and suction chambers is controlled by expansion or contracting of bellows 193 in response to the crank chamber pressure. As discussed above, bellows 193 is responsive at a predetermined response pressure to move valve member 195 into or out of spherical shaped opening 292*a*. However, since actuating rod 293 is forced forwardly due to the discharge pressure at the rear end of actuating rod 293 and the pressure in third chamber 85 at truncated cone section 293*c*, actuating rod 293 applies a forward acting force on bellows 193 through bias spring 500 and valve member 195. The forward acting force provided by rod 293 tends to urge bellows 193 to contract, and thereby lowers the crank chamber response pressure at which bellows 193 contracts to open passageway 150 linking the crank and suction chambers. Since the crank chamber response pressure of bellows 193 is affected by the force generated at both truncated cone section 293c and the rear end of actuating rod 293, the control of the link between crank and suction chambers 251 and 241 is responsive to both the discharge pressure and the pressure in third chamber 85.

Figure 5:
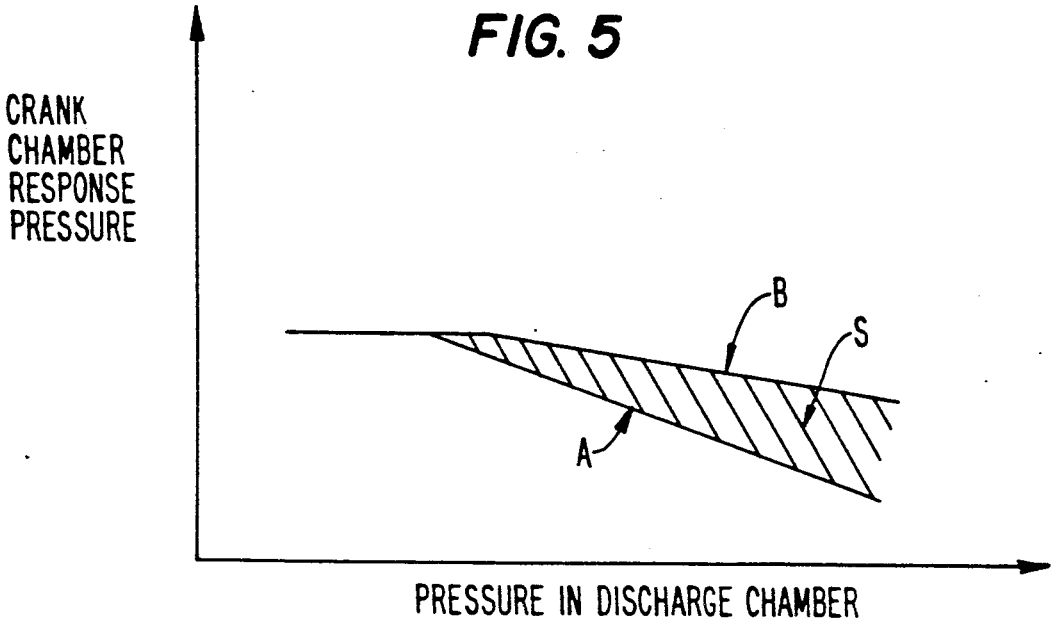
FIG. 5 is a graph illustrating an operating characteristic produced by the compressor in FIGS. 1 and 3.

Accordingly, when the value of the duty ratio control signal is 0%, pressure in third chamber 85 is maintained at the discharge pressure so that both the force which is generated by receiving the discharge pressure at truncated cone section 293c and the force which is generated by receiving the discharge pressure at the rear end of actuating rod 293, are applied to bellows 193. Therefore, when the value of the duty ratio control signal is maintained at 0%, the crank chamber response pressure of bellows 193 is lowered in accordance with an increase in pressure in discharge chamber 251 as shown by line "A" in a graph of FIG. 5. On the other hand, when the value of the duty ratio control signal is 100%, pressure in third chamber 85 is maintained at the suction pressure so that both the force which is generated by receiving the suction pressure at truncated cone section 293c and the force which is generated by receiving the discharge pressure at the rear end of actuating rod 293 are applied on bellows 193. Therefore, when the value of duty ratio control signal is maintained at 100%, the crank chamber response pressure of bellows 193 is lowered in accordance with an increase in pressure in discharge chamber 251 as shown by line "B" in a graph of FIG. 5. Furthermore, since the pressure in third chamber 85 varies from the discharge pressure to the suction pressure in response to changes in the value of the duty ratio control signal, the crank chamber response pressure of bellows 193 may be freely varied within hatched area "S" defined by lines "A" and "B".

Therefore, in this embodiment, the compressor can be suitably used in an elaborately operated automotive air conditioning system.

Figure 3:
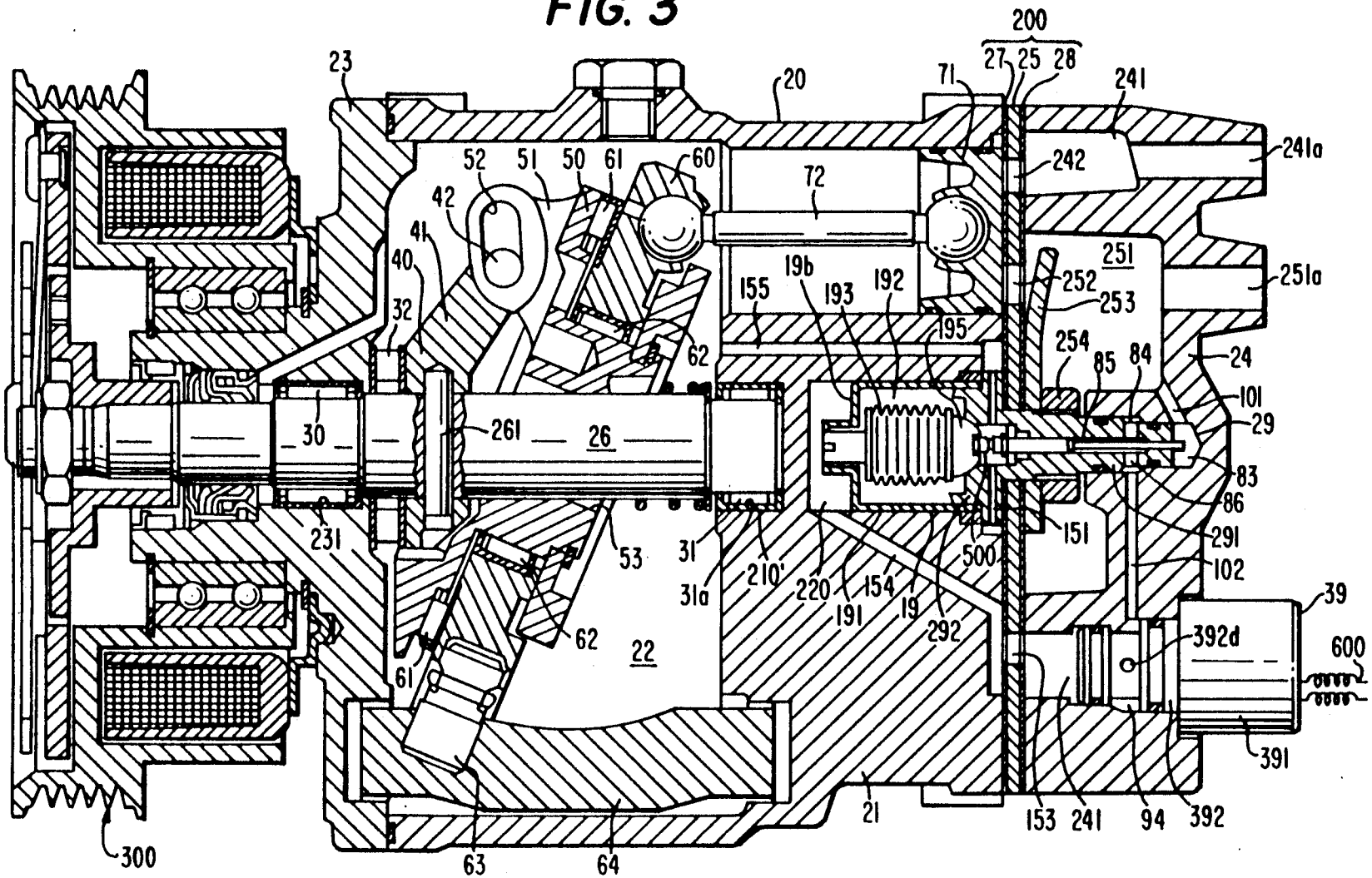
FIG. 3 is a vertical longitudinal sectional view of a wobble plate type refrigerant compressor including a valve control mechanism according to a second embodiment of this invention.

With reference to FIG. 3, a second embodiment of the present invention is disclosed. The second embodiment is identical to the first embodiment with the exception that bellows 193 is disposed so as to be responsive to the suction pressure. Specifically, central bore 210' terminates before the location of casing 191, and casing 191 is disposed in bore 220 which is isolated from bore 210' and thus from the suction chamber. Bore 220 is linked to suction chamber 241 through conduit 154 formed in cylinder block 21. Thus, valve chamber 192 is maintained at the suction chamber pressure by hole 153, conduit 154, bore 220 and holes 19b, and bellows 193 is responsive to the suction pressure. Additionally, conduit 151 formed through valve seat 292 is linked to crank chamber 22 through conduit 155 also formed through cylinder block 21. Thus, bellows 193 is responsive to the suction pressure to expand or contract and thereby open or close the passageway linking crank and suction chambers 22 and 241. Second valve control device 29 is identical in the first embodiment, and acts to adjust the suction chamber response pressure of bellows 193 in accordance with the duty ratio control signal.

Figure 4:
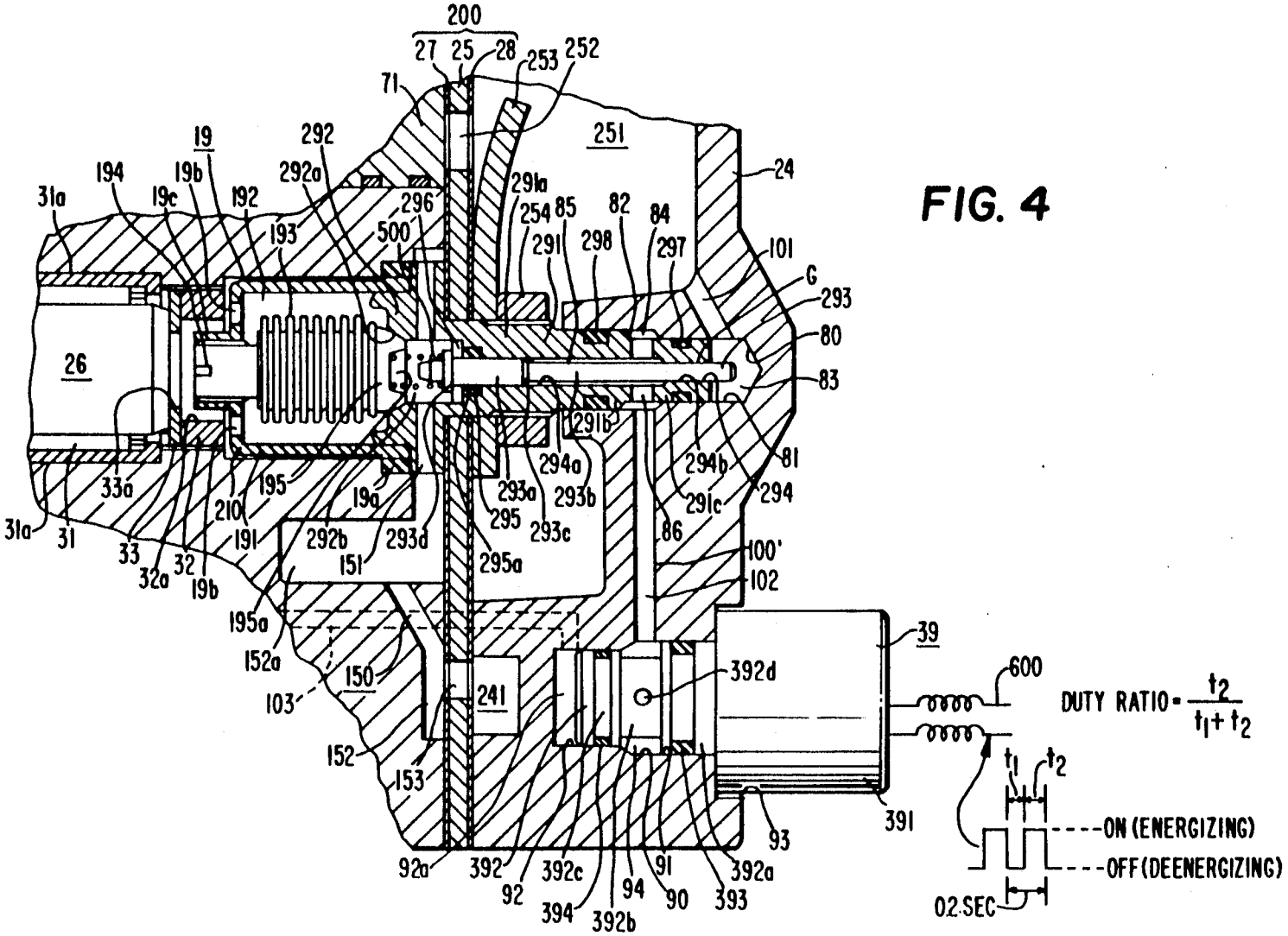
FIG. 4 is a view similar to FIG. 2 illustrating a valve control mechanism according to a third embodiment of this invention.

With reference to FIG. 4, a third embodiment of the present invention is disclosed. The third embodiment is identical to the first embodiment with the exception that solenoid valve mechanism 39 is disposed so as to control the communication between third chamber 85 and the crank chamber (not shown in FIG. 4). Specifically, second cylindrical hollow portion 90' terminates before the location of suction chamber 241 and is thereby isolated from suction chamber 241. Second hollow portion 90' includes cavity 92a located at the forward end of medium diameter section 392 c of valve device 392. Cavity 92a is linked to crank chamber 22 through conduit 103 formed through cylinder block 2, valve plate assembly 200 and rear end plate 24.

Figure 6:
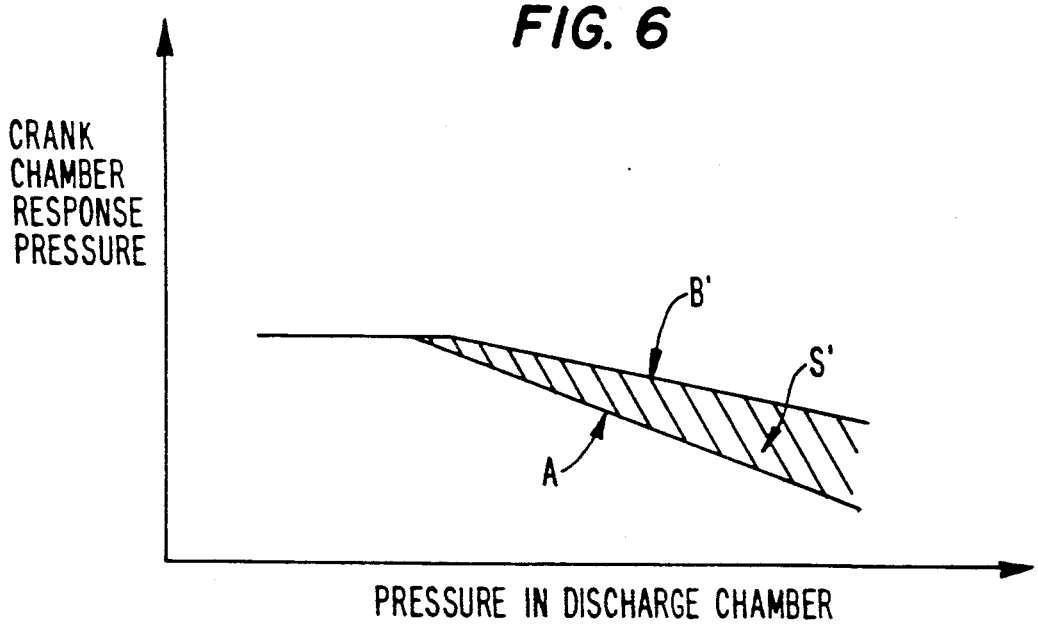
FIG. 6 is a graph illustrating an operating characteristic produced by the compressor in FIG. 4.
Figure 7:
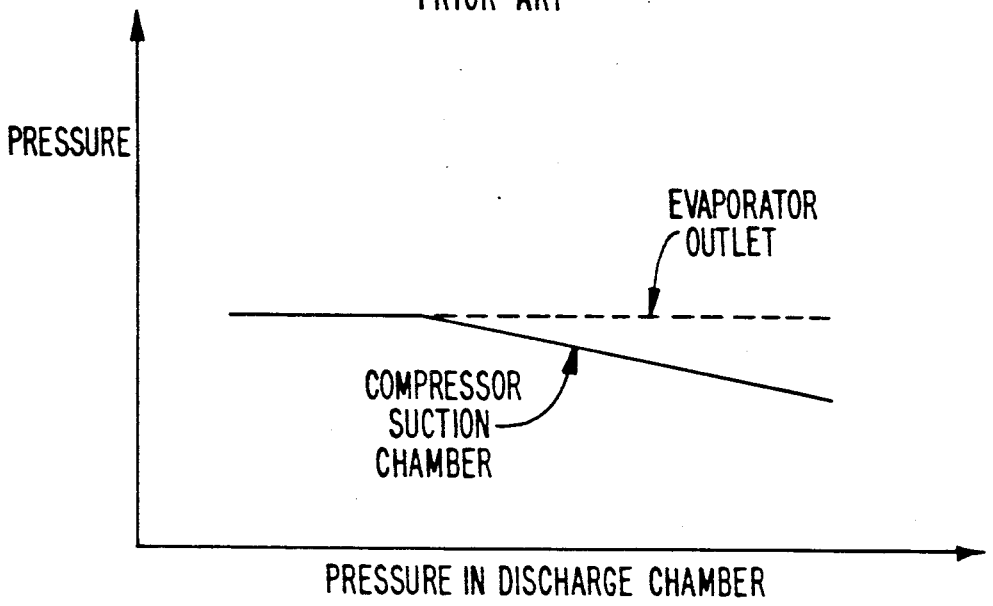
FIG. 7 PRIOR ART
FIG. 7 is a graph illustrating an operating characteristic produced by the compressor in accordance with the prior art.
Figure 8:
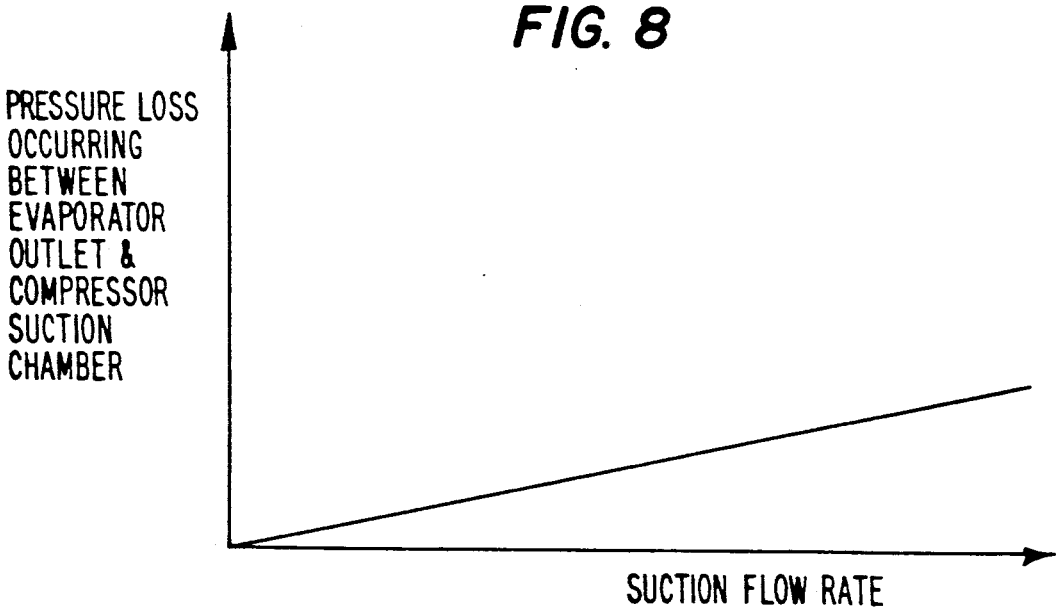
FIG. 8 is a graph showing the relationship between the pressure loss occurring between the evaporator outlet and the compressor suction chamber to the suction flow rate.

Accordingly, communication path 100' linking third chamber 85 with crank chamber 22 is formed by radial holes 86, second chamber 84, second conduit 102, annular cavity 94, the passageway formed in valve device 392, cavity 92a and conduit 103. Therefore, solenoid valve mechanism 39 varies the pressure in third chamber 85 between the discharge pressure to the crank pressure in response to changes in the value of the duty ratio control signal. As shown by a graph of FIG. 6, in this embodiment, the crank chamber response pressure of bellows 193 varies in hatched area "S'" defined by lines "A" and "B'", since the pressure in third chamber 85 varies from the discharge pressure to the crank pressure in response to changes in the value of the duty ratio control signal. In the graph of FIG. 6, line "B'" shows a situation in which the value of the duty ratio control signal is maintained at 100%. When the value of the duty ratio control signal is maintained at 100%, pressure in third chamber 85 is maintained at the crank pressure so that the crank chamber response pressure of bellows 193 is lowered in accordance with an increase in pressure in discharge chamber 251 as shown by line "B'" in the graph of FIG. 6. Line "A" once again represents the situation when the duty ratio is 0% and the pressure in chamber 85 equals the discharge pressure.

An effect of the second and third embodiments is similar to the effect of the first embodiment so that explanation thereof is omitted.

This invention has been described in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plant having a surface disposed at an adjustable inclined angle relative to a plane perpendicular to said drive shaft, the incline angle of said slant plate adjustable to vary the capacity of the compressor, a passageway formed in said housing and linking said crank chamber and said suction chamber in fluid communication, and capacity control means for varying the capacity of the compressor by adjusting the inclined angle, said capacity control means including a first valve control means and a response pressure adjusting means, said first valve control means for controlling the opening and closing of said passageway in response to changes in refrigerant pressure in said compressor to control the link between said crank and suction chambers to thereby control the capacity of the compressor, said first valve control means responsive at a predetermined pressure, said response pressure adjusting means responding to an external signal for adjusting the predetermined pressure, the improvement comprising;

said response pressure adjusting means including an actuating chamber linked to said discharge chamber through a first communicating path and linked to said suction chamber through a second communicating path, a throttling element disposed in said first communicating path, a second valve control means controlling the opening and closing of said second communicating path in order to vary the pressure in said actuating chamber from the pressure in said discharge chamber to the pressure in said suction chamber in response to said external signal, and an actuating device having a first surface which receives the pressure in said actuating chamber and a second surface which receives the pressure in said discharge chamber in order to apply a force to said first valve control means so that the predetermined response pressure at which said first valve control means responds is controllably changed in response to changes in pressure in said actuating chamber and changes in pressure in said discharge chamber.

2. The compressor recited in claim 1, said compressor housing further comprising a front end plate disposed at one end of said cylinder block and enclosing said crank chamber within said cylinder block, and a rear end plate disposed on the other end of said cylinder block, said discharge chamber and said suction chamber enclosed within said rear end plate by said cylinder block, said coupling means further comprising a rotor coupled to said drive shaft and rotatable therewith, said rotor further linked to said slant plate.

3. The compressor recited in claim 2 further comprising a wobble plate nutatably disposed about said slant plate, each said piston connected to said wobble plate by a connecting rod, said slant plate rotatable with respect to said wobble plate, rotation of said drive shaft, said rotor and said slant plate causing nutation of said wobble plate, nutation of said wobble plate causing said pistons to reciprocate in said cylinders.

4. The compressor recited in claim 1, said first valve control means comprising a longitudinally expanding and contracting bellows and a valve element attached at one end of said bellows.

5. The compressor recited in claim 4, said bellows expanding in response to the crank chamber pressure, said bellows expanding to close said passageway when the pressure is below the predetermined response pressure.

6. The compressor recited in claim 5, said bellows disposed in a bore formed in said cylinder block, said bore linked in fluid communication with said crank chamber.

7. The compressor recited in claim 1, said response pressure adjusting means comprising a solenoid actuating valve.

8. The compressor recited in claim 1, said first valve control means responsive to the suction chamber pressure.

9. The compressor recited in claim 1, said first valve control means responsive to the crank chamber pressure.

10. The compressor recited in claim 1, said first and second communicating paths sized and shaped such that the volume of fluid flowing into said suction chamber from said actuating chamber is equal to or greater than the maximum volume of fluid flowing into said actuating chamber from said discharge chamber.

11. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the incline angle of said slant plate adjustable to vary the capacity of the compressor, a passageway formed in said housing and linking said crank chamber and said suction chamber in fluid communication, and capacity control means for varying the capacity of the compressor by adjusting the inclined angle, said capacity control means including a first valve control means and a response pressure adjusting means, said first valve control means for controlling the opening and closing of said passageway in response to changes in refrigerant pressure in said compressor to control the link between said crank and suction chambers to thereby control the capacity of the compressor, said first valve control means responsive at a predetermined pressure, said response pressure adjusting means responding to an external signal for adjusting the predetermined pressure, the improvement comprising;

said response pressure adjusting means including an actuating chamber linked to said discharge chamber through a first communicating path and linked to said crank chamber through a second communicating path, a throttling element disposed in said first communicating path, a second valve control means controlling the opening and closing of said second communicating path in order to vary the pressure in said actuating chamber from the pressure in said discharge chamber to the pressure in said crank chamber in response to said external signal, and an actuating device having a first surface which receives the pressure in said actuating chamber and a second surface which receives the pressure in said discharge chamber in order to apply a force to said first valve control means so that the predetermined response pressure at which said first valve control means responds is controllably changed in response to changes in pressure in said actuating chamber and changes in pressure in said discharge chamber.

12. The compressor recited in claim 11, said compressor housing further comprising a front end plate disposed at one end of said cylinder block and enclosing said crank chamber within said cylinder block, and a rear end plate disposed on the other end of said cylinder block, said discharge chamber and said suction chamber enclosed within said rear end plate by said cylinder block, said coupling means further comprising a rotor coupled to said drive shaft and rotatable therewith, said rotor further linked to said slant plate.

13. The compressor recited in claim 12 further comprising a wobble plate nutatably disposed about said slant plate, each said piston connected to said wobble plate by a connecting rod, said slant plate rotatable with respect to said wobble plate, rotation of said drive shaft, said rotor and said slant plate causing nutation of said wobble plate, nutation of said wobble plate causing said pistons to reciprocate in said cylinders.

14. The compressor recited in claim 11, said first valve control means comprising a longitudinally expanding and contracting bellows and a valve element attached at one end of said bellows.

15. The compressor recited in claim 14, said bellows expanding in response to the crank chamber pressure, said bellows expanding to close said passageway when the pressure is below the predetermined response pressure.

16. The compressor recited in claim 15, said bellows disposed in a bore formed in said cylinder block, said bore linked in fluid communication with said crank chamber.

17. The compressor recited in claim 11, said response pressure adjusting means comprising a solenoid actuating valve.

18. The compressor recited in claim 11, said first valve control means responsive to the suction chamber pressure.

19. The compressor recited in claim 11, said first valve control means responsive to the crank chamber pressure.

20. The compressor recited in claim 11, said first and second communicating paths sized and shaped so as to have the volume of fluid flowing into said crank chamber from said actuating chamber be equal to or greater than the maximum volume of fluid flowing into said actuating chamber from said discharge chamber.

21. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate adjustable to vary the stroke length of said pistons in said cylinders to vary the capacity of the compressor, a passageway formed in said housing and linking said crank chamber and said suction chamber in fluid communication, and capacity control means for varying the capacity of the compressor by adjusting the inclined angle, said capacity control means including valve control means and response pressure adjusting means, said valve control means for controlling the opening and closing of said passageway in response to changes in refrigerant pressure in said compressor to control the fluid communication between said crank and said suction chambers to thereby control the capacity of the compressor, said valve control means responsive at a predetermined pressure, said response pressure adjusting means for controllably changing the predetermined pressure at which said valve control means responds, the improvement comprising:

said response pressure adjusting means including means for adjusting the predetermined pressure associated with said valve control means, and a variable pressure chamber, said means for adjusting the predetermined pressure responsive at a first location to the pressure in said variable pressure chamber and at a second location to the pressure in said discharge chamber, said valve control means responsive to the suction chamber pressure.

22. The compressor recited in claim 21 further comprising a variable pressure control means responsive to an external signal for varying the pressure in said variable pressure chamber.

23. The compressor recited in claim 22, the pressure in said variable pressure chamber variable between the suction chamber pressure and the discharge chamber pressure.

24. The compressor recited in claim 22, the pressure in said variable pressure chamber variable between the crank chamber pressure and the discharge chamber pressure.

25. The compressor recited in claim 21, said response pressure adjusting means comprising a member having a cylindrical channel therethrough, said means for adjusting the predetermined pressure including a cylindrical element slidably disposed in said cylindrical channel and having first and second portions joined at an intermediate location, said first portion having a smaller diameter than said second portion, said variable pressure chamber formed between the interior surface of said cylindrical channel and the exterior surface of said first portion, said second portion linked at an end thereof which is opposite said intermediate location to said valve control means, said first portion having an end opposite said intermediate location extending beyond said cylindrical channel and responsive to the pressure of said discharge chamber, said variable pressure chamber linked by a throttle to said discharge chamber, said cylindrical element moving in response to the discharge chamber pressure at said end of said first portion and to the pressure in said variable pressure chamber at said intermediate location to adjust the predetermined pressure.

26. The compressor recited in claim 25, said variable pressure chamber linked to said suction chamber, said response pressure adjusting means further comprising a variable pressure control means responsive to an external signal for controlling the link between said variable pressure chamber and said suction chamber to thereby controllably vary the pressure in said variable pressure chamber between the suction pressure and the discharge pressure.

27. The compressor recited in claim 25, said variable pressure chamber linked to said crank chamber, said response pressure adjusting means further comprising a variable pressure control means responsive to an external signal for controlling the link between said variable pressure chamber and said crank chamber to thereby controllably vary the pressure in said variable pressure chamber between the crank pressure and the discharge pressure.

28. The compressor recited in claim 25, said response pressure adjusting means comprising a further chamber, said further chamber linked by a conduit to said discharge chamber, said further chamber linked by said throttle to said variable pressure chamber, said end of said first portion extending into said further chamber.

29. The compressor recited in claim 25, said cylindrical channel comprising first and second portions, said second portion of said cylindrical channel having a smaller diameter than said first portion of said cylindrical channel, said first portion of said cylindrical element extending through said second portion of said cylindrical channel, said throttle comprising gaps formed between the exterior surface of said first portion of said cylindrical element and the interior surface of said second portion of said cylindrical channel.

30. The compressor recited in claim 21, said means for adjusting the predetermined pressure linked to said valve control means by an elastic element.

31. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate adjustable to vary the stroke length of said pistons in said cylinders to vary the capacity of the compressor, a passageway formed in said housing and linking said crank chamber and said suction chamber in fluid communication, and capacity control means for varying the capacity of the compressor by adjusting the inclined angle, said capacity control means including valve control means and a response pressure adjusting means, said valve control means for controlling the opening and closing of said passageway in response to changes in refrigerant pressure in said compressor to control the fluid communication between said crank and said suction chambers to thereby control the capacity of the compressor, said valve control means responsive at a predetermined pressure, said response pressure adjusting means for controllably changing the predetermined pressure at which said valve control means responds, the improvement comprising:

said response pressure adjusting means including means for adjusting the predetermined pressure associated with said valve control means, and a variable pressure chamber, said means for adjusting the predetermined pressure responsive at a first location to the pressure in said variable pressure chamber and at a second location to the pressure in said discharge chamber, said valve control means responsive to the crank chamber pressure.

* * * * *